United States Patent [19]

Ozu et al.

[11] Patent Number: 4,781,542

[45] Date of Patent: Nov. 1, 1988

[54] HERMETICALLY-SEALED COMPRESSOR WITH MOTOR

[75] Inventors: Masao Ozu, Fuji; Kanji Misawa, Fujimiya; Takahiro Togawa, Numazu, all of Japan

[73] Assignee: Kabushiki Kaisha Toshiba, Kawasaki, Japan

[21] Appl. No.: 55,598

[22] Filed: May 29, 1987

[30] Foreign Application Priority Data

| | | | |
|---|---|---|---|
| Jun. 2, 1986 | [JP] | Japan | 61-127771 |
| Jun. 3, 1986 | [JP] | Japan | 61-128550 |
| Jul. 11, 1986 | [JP] | Japan | 61-163462 |

[51] Int. Cl.[4] ..... F04B 39/02

[52] U.S. Cl. ..... 417/369; 417/902; 418/88; 418/188; 184/6.16

[58] Field of Search ..... 184/6.16; 418/63, 88, 418/95, 98, 188; 417/366, 369, 410, 902

[56] References Cited

U.S. PATENT DOCUMENTS

| | | | |
|---|---|---|---|
| 4,518,330 | 5/1985 | Asami et al. | 418/88 X |
| 4,636,154 | 1/1987 | Sugiyama et al. | 184/6.16 X |
| 4,645,429 | 2/1987 | Asami et al. | 417/366 X |

FOREIGN PATENT DOCUMENTS

| | | | |
|---|---|---|---|
| 3430650 | 3/1985 | Fed. Rep. of Germany | 417/366 |
| 52-018212 | 2/1977 | Japan | 418/98 |
| 61-10992 | 1/1986 | Japan . | |

*Primary Examiner*—Carlton R. Croyle
*Assistant Examiner*—Eugene L. Szczecina, Jr.
*Attorney, Agent, or Firm*—Foley & Lardner, Schwartz, Jeffery, Schwaab, Mack, Blumenthal & Evans

[57] ABSTRACT

A horizontal type compressor-motor combination for compressing a gaseous refrigerant is hermetically sealed within a case which contains in its bottom accumulated lubricating oil and is internally divided into compressor and motor chambers respectively housing a compressor device and a motor for driving the compressor device through a common rotor shaft coupling the rotor of the motor and an eccentric rotor of the compressor device and being rotatably supported by inner and outer bearings, the compressor device having a cylinder block interposed between the inner and outer bearings. A compressor-motor of this basic organization is improved by a communication passage formed axial through the rotor shaft for conducting the refrigerant, one end of this passage being connected to the motor chamber, the other end being connected to a delivery chamber of the compressor chamber. By this structural organization, the gaseous refrigerant compressed to a high pressure in the compressor device is conducted through the passage formed through the rotor shaft or a passage through the outer bearing, cylinder block, and inner bearing into the rotor chamber thereby to raise the oil level in the compressor chamber, whereby lubricating oil is supplied positively and stably to the bearings and other moving parts.

4 Claims, 2 Drawing Sheets

HERMETICALLY-SEALED COMPRESSOR WITH MOTOR

BACKGROUND

This invention relates to horizontal combination compressor and motors which are hermetically sealed within a case; and more particularly to such sealed compressors and motors installed in air conditioners, refrigerators, freezers, and the like. More specifically, the invention relates to a compressor and motor of the type in which the enclosing sealed case is divided by a partition plate into a compressor chamber and a motor chamber. By maintaining the surface level the lubricating oil in a compressor chamber oil sump higher than that of lubricating oil in the motor chamber, lubricating oil is stably supplied to the bearings of the compressor rotor shaft.

In general, a horizontal tape, hermetically-sealed, rotary compressor has a sealing case whose interior is divided by a partition plate into a compressor chamber in which a compressor device is accommodated and a motor chamber in which an electric motor for driving the compressor device is accommodated. In a compressor of this character, the rotor of the electric motor and the eccentric rotor of the compressor device are coupled by a horizontal rotor shaft, which is rotatably supported within the sealed case by bearings. It is necessary to supply lubricating oil to the rotationally sliding parts between the rotor shaft and its bearings. For this purpose, it has been a conventional practice to forcibly supply lubricating oil to the parts requiring lubrication by pumping lubricating oil up from an oil sump at the bottom of the sealed case by means of an oil supply pump.

For obtaining a stable positive supply of lubricating oil, it is advantageous to set the oil surface in the oil sump in the compressor chamber at a higher level than that in the motor chamber. For this purpose, it has been the practice heretofore to conduct the gaseous refrigerant which has been compressed by the compressor device through an external connection pipe installed outside of the sealed case to the motor chamber, and to hold down the height of the oil surface in the oil sump within the motor chamber while maintaining the oil surface on the compressor chamber side at a high level. In this connection, the gaseous refrigerant at high pressure which has been thus conducted to the motor chamber is returned again to the compressor chamber through a gap between the stator and rotor of the electric motor or through vent passages formed in the stator and is then sent through a delivery pipe to a condenser of the refrigeration system (as described in Japanese Utility Model Application "Kokai" Publication No. 10992/1986).

The above described conventional compressor, however, tends to become bulky in size and requires a large installation space because of the installation of the connection pipe outside of the sealed case. Furthermore, the connection pipe is easily damaged during transportion or at the time of installation.

SUMMARY

Accordingly, an object of this invention is to provide a compressor of the type in which, by maintaining the oil surface of the lubricating oil in the oil sump on the compressor chamber side at a high level at the time of operation, lubricating oil can be supplied in a stable state to the mechanical parts requiring lubrication.

According to this invention, briefly summarized, there is provided a horizontal type, hermetically-sealed compressor with motor comprising a sealed case containing in the bottom thereof accumulated lubricating oil and having an interior divided into a motor chamber and a compressor chamber, an electric motor enclosed within the motor chamber, a compressor device enclosed within the compressor chamber, a common rotor shaft coupling the rotor of the electric motor and an eccentric rotor of the compressor device, and inner and outer bearings rotatably supporting the rotor shaft, the compressor device having a cylinder block interposed between the inner and outer bearings, a delivery pipe being connected to the compressor chamber, this compressor with motor being characterized by a communication passage formed axially through the rotor shaft for conducting a gaseous refrigerant therethrough, one end of said communication passage being communicatively connected to the motor chamber, the other end thereof being communicatively connected to a delivery chamber or the compressor chamber.

According to this invention, the gaseous refrigerant compressed to a high pressure in the cylinder chamber of the compressor device is conducted through a communication passage formed axially through the rotor shaft or a passage formed through the outer bearing, the cylinder block, and the inner bearing into the motor chamber thereby to raise the gas pressure within the motor chamber. Accordingly, the oil surface level in the oil sump in the compressor chamber is raised, whereby the lubricating oil can be supplied positively and steadily to the bearings and other moving parts. Furthermore, since the passage for the gaseous refrigerant communicatively connecting the compressor chamber and the motor chamber is provided on the inner side of the hermetically sealed case, the entire hermetically sealed compressor with motor can be made compact and does not occupy a large installation space.

The nature, utility, and further features of this invention will be more clearly apparent from the following detailed description with respect to preferred embodiments of the invention when read in conjunction with the accompanying drawings, briefly described below.

DRAWINGS

DETAILED DESCRIPTION

Figure 1:
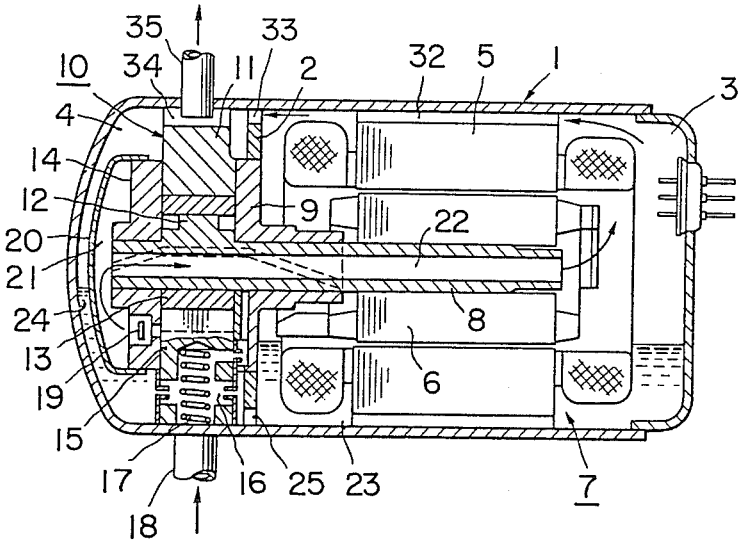
FIG. 1 is a side view, in longitudinal section, showing one example of the horizontal type, hermetically-sealed compressor according to this invention.
Figure 2:
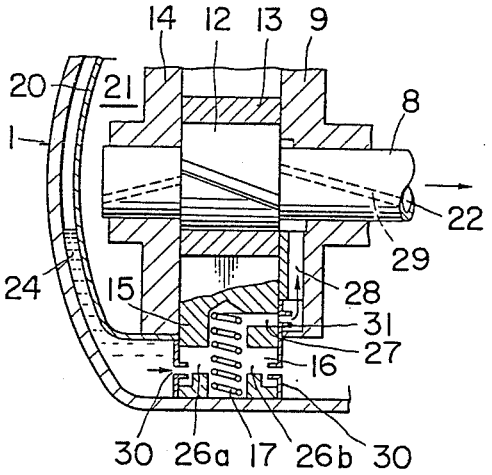
FIG. 2 is a relatively enlarged partial side view, in longitudinal section showing an oil supply pump part of the compressor.

Referring first to FIGS. 1 and 2, the compressor with motor of this invention is fully enclosed in hermetically sealed state within a sealed case 1, the interior of which is divided by a partition plate 2 into a motor chamber 3 and a compressor chamber 4. The motor chamber 3 accommodates therewithin a motor 7 comprising in coaxially assembled state a stator 5 and a rotor 6. The axis of rotation of the rotor 6 is horizontal.

The rotor 6 is supported by a rotor shaft 8 coaxially passing therethrough and fixed thereto. This rotor shaft 8 extends toward the above mentioned compressor chamber 4 and, at the section of the partition plate 2, is rotatably supported by an inner bearing 9.

Within the compressor chamber 4 is disposed in assembled state a rotary compressor 10, which is provided with a cylinder block 11, an eccentric rotor 12 formed integrally with a part of the rotor shaft 8, and a roller sleeve 13. Against the axially outer face of the cylinder block 11 is secured an outer bearing 14. This outer bearing 14, the cylinder block 11, and the inner bearing 9 form therebetween a space which constitutes the cylinder chamber of the rotary compressor 10. This cylinder chamber is divided by a vane 15 into a high-pressure chamber and a low-pressure chamber. This vane 15 is slideably fitted within a vane chamber 16 and is pressed against the outer surface of the roller sleeve 13 by the elastic force of a compressed coil spring 17. A suction pump 18 is connected to the above mentioned low-pressure chamber of the cylinder chamber and serves to conduct a gas to be compressed such as, for example, a gaseous refrigerant, into the low-pressure chamber.

On the discharge or delivery side, a delivery valve 19 is provided in the outer bearing 14 and functions to discharge out of the compressor 10 a gas, such as a gaseous refrigerant, which has been compressed to a high pressure in the high-pressure chamber This gas which, has been compressed by the eccentric rotation of the roller sleeve 13 is discharged through this delivery valve 19.

According to this invention, a delivery cover 20 is fitted around and on the outer peripheral surface of the outer bearing 14 and forms therewithin a delivery chamber 21. This delivery chamber 21 and the motor chamber 3 are interconnected by a communication passage 22 bored longitudinally through the center of the rotor shaft 8. Therefore, the delivery gas is supplied through the communication passage 22 into the motor chamber 3, whereby the gas pressure within the motor chamber can be maintained at a high value.

In the sealed compressor with motor of the above described construction, lubricating oil is supplied to the bearings and other moving parts by the mechanism described hereinunder.

At the bottom parts of the motor chamber 3 and the compressor chamber 4, oil sumps 23 and 24 are respectively formed for collecting of lubricating oil. These oil sumps 23 and 24 are intercommunicated by a communication hole 25 formed through a lower part of the partition plate 2. The lubricating oil in the oil sump 24 is forcibly supplied to parts requiring lubrication by an oil supply pump utilizing the pumping action of the aforementioned vane 15. More specifically, the vane 15 is so assembled that it is capable of undergoing reciprocating motion within the vane chamber 16, and, at a lower part of the cylinder block 11, oil suction ports **26*a* and 26*b* and an oil delivery port 27 are formed so as to communicate with the vane chamber 16 as shown on an enlarged scale in FIG. 2**.

The oil delivery port 27 is communicative with one end of an oil supply passage 28, which at its other end communicates with an oil groove 29 formed along a helical path around the outer surface of the rotor shaft 8. The oil suction ports **26*a* and 26*b* are provided with respective inlet one-way valves 30, while the oil delivery port 27 is provided with an outlet one-way valve 31**.

A plurality of vent passages 32 extending parallel to the axial direction are provided around a part of the outer periphery of the stator 5, and cutouts 33 are formed through the partition plate 2 in alignment with these air passages 32. At a part of the outer periphery of the cylinder block 11 is formed an air passage groove 34, which communicates with a delivery pipe 35 fixed to and passing through the hermetically sealed case 1.

When the motor 7 in the compressor, as above described, starts to rotate the roller sleeve 13 within the cylinder chamber, gaseous refrigerant is drawn through the suction pipe 18 into the low-pressure chamber, is compressed in the cylinder chamber by the roller sleeve 13, and is discharged through the delivery valve 19 into the delivery chamber 21. The high-pressure gaseous refrigerant thus discharged flows through the communication passage 22 formed axially through the rotor shaft 8 and is conducted into the motor chamber 3. This gaseous refrigerant is then conducted under pressure through the vent passages 32, the cutouts 33, and the vent passage groove 34 and is thereafter delivered through the delivery pipe to a condenser (not shown).

At the same time, the lubricating oil which has been collected in the oil sump 24 is drawn through the inlet one-way valves 30 into the oil suction ports **26*a* and 26*b* by the pumping action of the reciprocating motion of the vane 15 at the time of operation and is pressurized by the vane 15 within the vane chamber 16. The oil thus pressurized is then sent through the oil delivery port 27 and the outlet one-way valve 31 into the oil supply passage 28 and is supplied into the spiral oil groove 29 of the rotor shaft 8 to lubricate the rotationally sliding parts of the rotor shaft 8**.

As the operation is thus continued, the gas pressure within the motor chamber 3 becomes progressively higher than the gas pressure within the compressor chamber 4. As a consequence, the lubricating oil in the sump 23 at the bottom of the motor chamber 3 moves over to the side of the compressor chamber 4, and the surface level of the oil in the oil sump 24 at the bottom of the compressor chamber 4 gradually becomes higher. The lubricating oil is thereby supplied amply in a stable state.

In the above described example, however, since the gas pressure in the delivery chamber 21 within the delivery cover 20 rises, there is the possibility of difficulty arising in the supplying of lubricating oil to the bearing surface of the outer bearing 14 on which the end of the rotor shaft 8 is rotatably supported, and at the same time there is the possibility of a portion of the lubricating oil which has flowed past the bearing surface of the outer bearing 14 into the delivery chamber 21 becoming mixed with the gaseous refrigerant and being sent through the communication passage 22 into the motor chamber 3.

Figure 3:
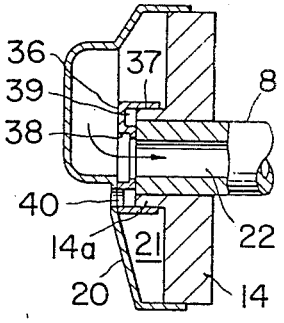
FIGS. 3 and 4 are partial side views, in longitudinal section, respectively showing different modes of providing oil covers of an outer bearing of the compressor.
Figure 4:
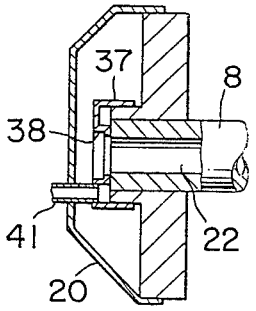

Accordingly, in order to solve this problem, an oil cover 36 is provided at the boss part **14*a* of the outer bearing 14 according to this invention as shown in FIG. 3. This oil cover 36 has an outer flange 37 and an inner flange 38 joined together by a web, whereby an annular recess 39 is formed by and between these parts. The dimensions of these parts are so selected that the bearing surface of the outer bearing 14 is alined with the middle part of this recess 39. Furthermore, through a lower part of this recess 39, a flow outlet 40 is formed, thereby to cause lubricating oil which has flowed out to drop into the oil sump 24 of the compressor chamber 4. As an alternative arrangement, it is also possible to connect an outlet pipe 41 to the flow outlet 40 as shown in FIG. 4** thereby to discharge oil which has leaked.

Figure 5:
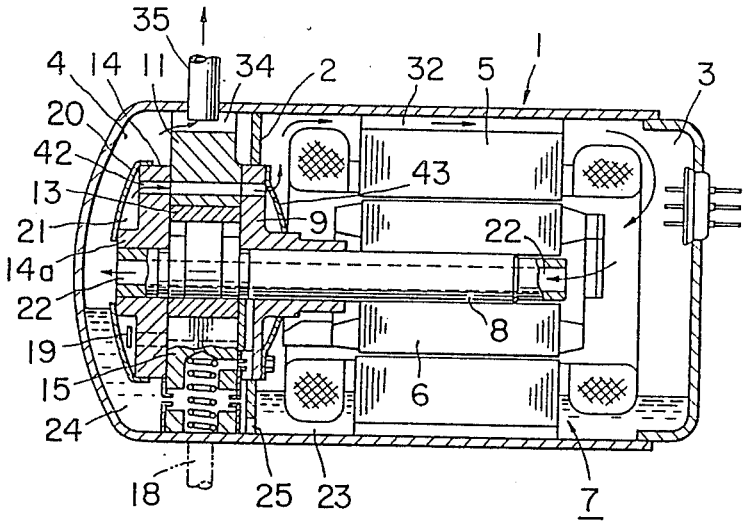
FIG. 5 is a side view, in longitudinal section, showing another embodiment of the invention.

In the above described example of this invention, a communication passage 22 formed axially through the rotor shaft 8 is utilized as means for conducting the gaseous refrigerant at high pressure, which has been compressed in the cylinder chamber, into the motor chamber 3, but this invention is not thus limited, it being also possible to use this communication passage 22 as means for conducting the gaseous refrigerant in the motor chamber into the compressor chamber 4. One example of such a modification is illustrated in FIG. 5, in which those constituent parts which are the same as or equivalent to corresponding parts in FIG. 1 are designated by like reference numerals. Detailed description of such parts will not be repeated. Different parts and features are as follows.

In this example shown in FIG. 5, the delivery cover 20 is so installed as to extend from the radially outer periphery of the outer bearing 14 to the boss part 14*a* thereof and to cover the space therebetween thereby forming an annular delivery chamber 21 on the inner side of the delivery cover 20. This delivery chamber 21 and the motor chamber 3 are made communicative by a passage 42 formed through the outer bearing 14, the cylinder block 11, and the inner bearing 9. A protective cover 43 is provide on the outlet side of this passage 42.

In the sealed compressor with motor of the above described organization, gaseous refrigerant at high pressure which has been discharged into the delivery chamber 21 flows through the passage 42 and is discharged into the motor chamber 3, after which it passes through the vent passages 32 and is conducted to the right-hand end of the motor chamber 3. This refrigerant then flows around the coil end of the motor and, passing through the communication passage 22 in the rotor shaft 8, is again returned to the side of the compressor chamber 4 to be sent through the delivery pipe 35 to the condenser.

Figure 6:
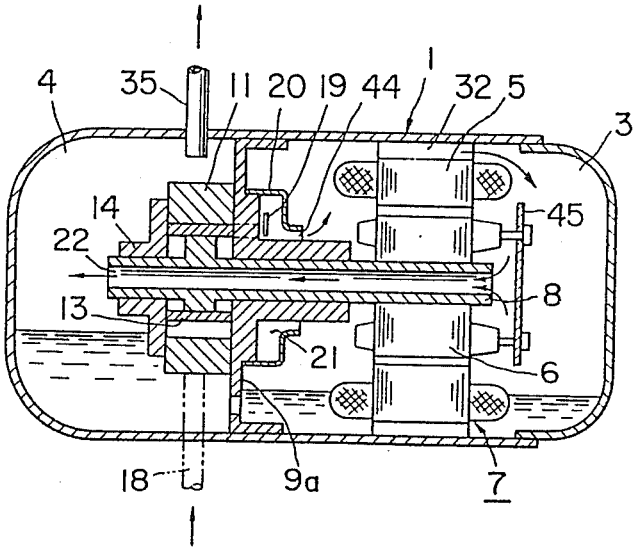
FIG. 6 is also a side view, in longitudinal section, showing still another embodiment of the invention.

In still another embodiment of this invention as shown in FIG. 6, the delivery valve and the delivery chamber of the compressing device are formed on the side of the motor chamber. That is, as shown, a delivery valve 19 communicating with the cylinder chamber is provided at a flange part 9*a* of the inner bearing 9. A delivery cover 20 is installed so as to enclose this delivery valve 19, and a delivery chamber 21 of annular shape is formed on the inner side of this delivery cover 20. An annular delivery outlet 44 is formed between the small-diameter end (right-hand end as viewed in FIG. 6) of the delivery cover 20 and the boss part of the inner bearing 9.

In this example of the hermetically sealed compressor with motor according to this invention, the gaseous refrigerant compressed to a high pressure is discharged through the delivery valve 19 into the delivery chamber 21, thereafter flows through the delivery outlet 44 to flow into and fill the motor chamber 3, thereafter passes through the vent passages 32 to the right-hand end of the motor chamber 3, flows around the motor, coil end, flows through the communication passage formed axially through the rotor shaft 8, is returned again to the side of the compressor chamber 4, and is then delivered through the delivery pipe 35 to the condenser. In this connection, by providing an oil separating plate 45 of disk shape at the right-hand end of the rotor 6, oil droplets can be separated from within the gaseous refrigerant when it enters the communication passage 22.

What we claim is:

1. In a hermetically-sealed compressor and motor, a lubricating system comprising: a sealed case containing in the bottom thereof accumulated lubricating oil, its interior divided into a motor chamber and a compressor chamber, an electric motor enclosed within the motor chamber and having a rotor, a compressor means enclosed within the compressor chamber and having an eccentric rotor, a common rotor shaft coupling the rotor of the electric motor and the eccentric rotor of the compressor means, and inner and outer bearings rotatably supporting the rotor shaft, the compressor means having a cylinder block interposed between the inner and outer bearings, and a delivery pipe connected to the compressor chamber; the improvement comprising a communication passage extending axially through the rotor shaft for conducting a gaseous refrigerant therethrough, one end of said communication passage being communicatively connected to the motor chamber, and a delivery cover secured to an outer surface of the outer bearing to define a delivery chamber between the delivery cover and the outer bearing, said delivery chamber being communicatively connected to the other end of said communication passage, whereby said gaseous refrigerant is supplied directly through the communication passage into the motor chamber, the surface level of lubricating oil in the compressor chamber being maintained at a higher level than that of the lubricating oil in the motor chamber as a result of this pressure.

2. The lubricating system according to claim 1 in which the outer end of the bearing surface of the outer bearing supporting the rotor shaft is covered by an oil cover.

3. In a hermetically-sealed compressor and motor, a lubricating system comprising: a sealed case containing in the bottom thereof accumulated lubricating oil and having an interior divided into a motor chamber and a compressor chamber, an electric motor enclosed within the motor chamber and having a rotor, compressor means enclosed within the compressor chamber and having an eccentric rotor, a common rotor shaft coupling the rotor of the electric motor and the eccentric rotor of the compressor means, inner and outer bearings rotatably supporting the rotor shaft, the compressor means having a cylinder block interposed between the inner and outer bearings and a delivery pipe connected to the compressor chamber; the improvement comprising a communication passage extending axially through the rotor shaft for conducting a gaseous refrigerant therethrough, one end of said communication passage being communicatively connected to the motor chamber, the other end thereof being communicatively connected to the compressor chamber, a delivery cover secured to an outer periphery of the outer bearing to define an annular delivery chamber between the delivery cover and the outer bearing, and means for forming a passage through the outer bearing, the cylinder block and the inner bearing for communicatively connecting said delivery chamber and said motor chamber, whereby the delivery gas is supplied directly through the passage into the motor chamber and returned through the communication passage from the motor chamber to the compressor chamber.

4. The lubricating system of claim 1, further including means enabling the accumulated oil in the motor chamber to enter the compressor chamber in response to pressure thereupon from the gaseous refrigerant entering the motor chamber.

* * * * *